US005895161A

United States Patent [19]

Winkler et al.

[11] Patent Number: 5,895,161

[45] Date of Patent: Apr. 20, 1999

[54] COSMETIC PENCIL

[75] Inventors: Wolfgang Winkler, Lauf; Georg Röder, Schwabach; Ulrich Griebel, Altdorf, all of Germany

[73] Assignee: Schwan-STABILO Cosmetics GmbH & Co.

[21] Appl. No.: 08/849,745

[22] PCT Filed: Nov. 22, 1995

[86] PCT No.: PCT/DE95/01656

§ 371 Date: Jun. 16, 1997

§ 102(e) Date: Jun. 16, 1997

[87] PCT Pub. No.: WO96/18323

PCT Pub. Date: Jun. 20, 1996

[30] Foreign Application Priority Data

Dec. 17, 1994 [DE] Germany ..... 44 45 230

[51] Int. Cl.[6] ..... A45D 40/06; A45D 40/12

[52] U.S. Cl. ..... 401/75; 401/68

[58] Field of Search ..... 401/75, 68, 76, 401/173, 174, 172

[56] References Cited

U.S. PATENT DOCUMENTS

| | | | |
|---|---|---|---|
| 3,232,275 | 2/1966 | Ziegler et al. | 401/68 X |
| 3,256,980 | 6/1966 | Bau | 401/75 |
| 4,136,980 | 1/1979 | Leem | 401/75 X |
| 4,560,297 | 12/1985 | Leem | 401/75 X |
| 4,993,858 | 2/1991 | Mock | 401/68 X |
| 5,004,363 | 4/1991 | Huttner et al. | 401/68 X |
| 5,553,956 | 9/1996 | Mitsuya et al. | 401/75 X |

*Primary Examiner*—David J. Walczak
*Assistant Examiner*—Kathleen J. Prunner
*Attorney, Agent, or Firm*—Bachman & Lapointe, P.C.

[57] ABSTRACT

Described is a cosmetic pencil (10) having a casing shank portion (12) and a casing front portion (14). A cosmetic stick (24) is displaceable by of a drive element (22) in relation to the front casing opening (40) of the casing front portion (14). In order to be able to move the cosmetic stick (24) both out of the casing and also back into the casing, the drive element (22) is in the form of a tubular stick holding member (26) which is arranged in the casing front portion (14) movably axially in opposite directions. The cosmetic stick (24) which projects out of the stick holding member (26) is fixed with a rear fixing portion (42) in the stick holding member (26). In order to ensure freedom from play at any time between the cosmetic stick (24) and the casing front portion (14) or the casing opening (40) thereof, the peripheral surface (34) of the cosmetic stick (24) is steplessly aligned with the outside surface (32) of the stick holding member (26), wherein the outside diameter of the peripheral surface (34) of the cosmetic stick (24) and the outside diameter of the outside surface (32) of the stick holding member (26) corresponds to the inside diameter of the casing opening (40) of the casing front portion (14) of the cosmetic pencil (10).

4 Claims, 2 Drawing Sheets

COSMETIC PENCIL

The invention concerns a cosmetic pencil having a casing shank portion, a casing front portion connected to the casing shank portion, and a drive element which is provided for moving a cosmetic stick in relation to a casing opening of the casing front portion and which is in the form of a tubular stick holding member which is axially movably arranged in the casing front portion, wherein the cosmetic stick which projects with an application portion out of the tubular stick holding member is fixed with a rear fixing portion in the tubular stick holding member and the application portion of the cosmetic stick extends in a play-free condition through the casing opening of the casing front portion.

DE 37 28 427 Cl discloses a cosmetic pencil having a casing shank portion and a casing front portion connected to the casing shank portion, as well as a drive element for moving a cosmetic stick in relation to a casing opening of the casing front portion. That known cosmetic stick is provided either with a cast cosmetic stick or with an extruded cosmetic stick. In the forward feed movement, the cosmetic stick performs not only a forward feed movement relative to the casing front portion, but at the same time a rotary movement, and that is found to cause problems. The same applies to the cosmetic pencil known from GB-A 956 651. In that case also the cosmetic stick, relative to the casing front portion, performs not only a forward feed movement but at the same time also a rotary movement. In addition, in the case of the cosmetic pencil of the last mentioned kind, it is necessary for the cosmetic stick to be inserted into and fixed in a fixing portion which is provided for receiving it and which is disposed at the front end of a screwthreaded spindle. The operation of fitting the cosmetic stick is correspondingly complicated and expensive, in the case of that known cosmetic pencil.

A cosmetic pencil in the form of a lipstick is known from DE 37 11 036 Al. In the case of that lipstick, when it performs its forward feed movement the cosmetic stick portion admittedly does not perform a troublesome rotary movement in relation to the casing front portion, but between the edge of the casing opening of the casing front portion and the peripheral surface of the cosmetic stick portion there is a gap which corresponds to the wall thickness of the holding member for holding the cosmetic stick portion and which is found to cause difficulties.

DE 32 15 215 C2 describes a cosmetic pencil having a casing shank portion and a casing front portion connected thereto, and a drive element for moving a cosmetic stick in relation to a casing opening of the casing front portion, wherein that cosmetic pencil is only suitable for moving the cosmetic stick forwardly out of the casing opening. A return movement of the cosmetic stick back into the casing is not possible with that known cosmetic pencil.

A cosmetic pencil of the kind set forth in the opening part of this specification is known from U.S Pat. No. 4 820 070. That publication gives no information about the diameter of the cosmetic stick. It is clear however that, with that known cosmetic pencil, the tubular stick holding member is of a length which is substantially shorter than the longitudinal extent of the casing front portion of that cosmetic pencil. Furthermore, in that case the application portion of the cosmetic stick has a peripheral surface whose diameter is smaller than the outside surface of the stick holding member. There is therefore a step at the location between the stick holding member and the application portion of the cosmetic stick.

The object of the present invention is that of providing a cosmetic pencil of the kind set forth in the opening part of this specification, in which a thin cosmetic stick can be displaced out of the casing front portion and back into the casing front portion, with the thin cosmetic stick being disposed in a play-free condition in the casing opening.

In a cosmetic pencil of the kind set forth in the opening part of this specification, in accordance with the invention, that object is attained in that the cosmetic stick is of a constant diameter which is between 2 and 6 mm, that the peripheral surface of the application portion of the cosmetic stick is steplessly aligned with the outside surface of the tubular stick holding member and that the tubular stick holding member is of a length which is slightly greater than the longitudinal extent of the casing front portion.

The cosmetic pencil according to the invention has the advantages that, with the above-mentioned thin cosmetic sticks with a constant diameter of between 2 and 6 mm there is freedom from play between the cosmetic stick and the casing opening of the casing front portion, while it is advantageously possible not only for the cosmetic stick to be moved out of the casing front portion but also moved back into the casing front portion, with a relative rotary movement as between the cosmetic stick and the casing front portion being avoided.

In the case of the cosmetic pencil according to the invention, the cosmetic stick is preferably cast into the tubular stick holding member from the rear end thereof. Such a process and an apparatus for carrying out that process are described in German patent application No. P 44 45 231.4.

It has been found advantageous if, in the cosmetic pencil according to the invention, the tubular stick holding member is axially adjustably movably disposed in the casing front portion in such a way as to be prevented from rotating and at its rear end portion which projects at the rear out of the casing front portion, it is provided with a male screwthread, and if the casing shank portion has a female screwthread portion in which the male screwthread element of the tubular stick holding member is screwably disposed. Such a configuration affords the advantage that, upon rotary movement of the casing front portion with respect to the casing shank portion, the cosmetic stick is moved out of or into the casing front portion, while relative rotary movement as between the casing front portion and the cosmetic stick is prevented.

In order to prevent damage to the male screwthread element provided on the tubular stick holding member or damage to the female screwthread portion of the casing shank portion, it is desirable for the male screwthread element to be provided with a resiliently yielding means to prevent overrotation thereof.

Reliable fixing of the cosmetic stick to the tubular stick holding member is afforded if the front portion of the tubular stick holding member has fixing elements for the cosmetic stick. Those fixing elements may be knobs, ribs, at least one stepped shoulder or the like, thereby in particular reliably preventing the cosmetic stick from dropping out of the stick holding member or out of the casing front portion of the cosmetic pencil, using simple means.

Particularly when, in the cosmetic pencil according to the invention, the cosmetic stick has volatile constituents, it is preferable for the tubular stick holding member to be sealed off by a sealing element at its rearward end portion. That sealing element may be a ball, stopper, plug or the like.

Further details, features and advantages will be apparent from the following description of an embodiment, illustrated in the drawing, of the cosmetic pencil according to the invention. In the drawing.

Figure 1:
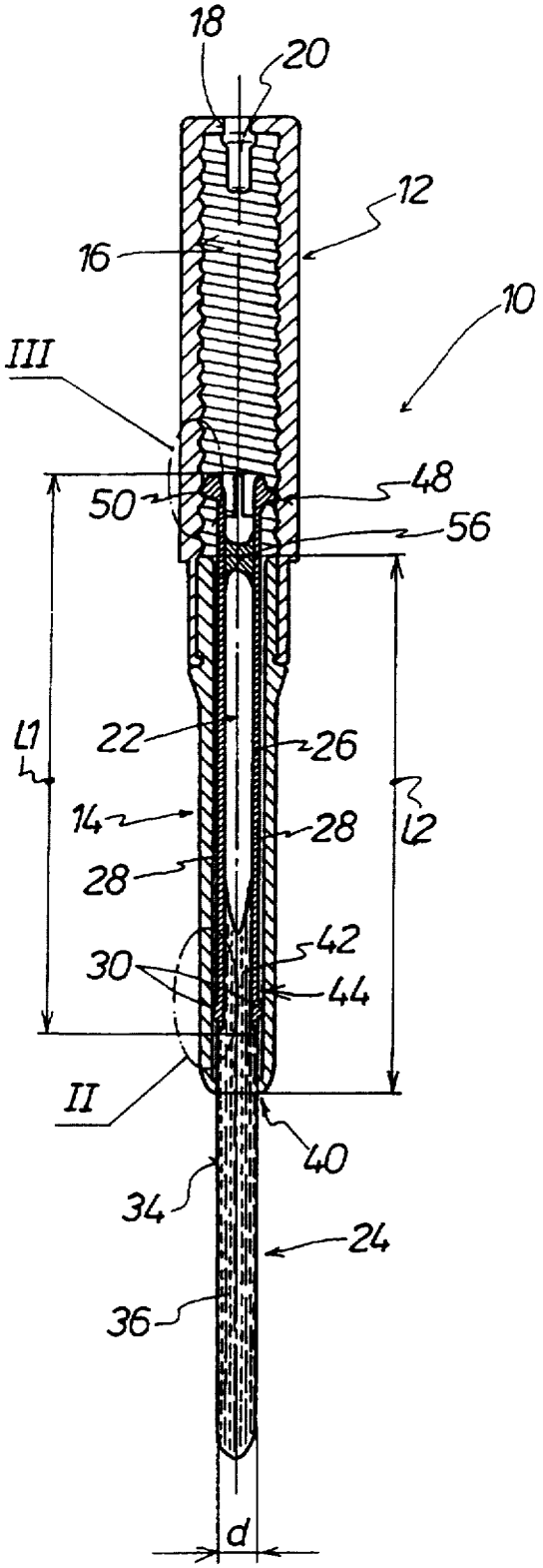
FIG. 1 is a view in longitudinal section through the cosmetic pencil, with the cosmetic stick being shown in a condition of being moved far out of the casing front portion.

FIG. 1 shows a cosmetic pencil 10 having a casing shank portion 12 and a casing front portion 14 which are connected together axially immovably and rotatably relative to each other. The casing shank portion 12 is provided with a female screwthread portion 16. At its rear end the casing shank portion 12 may have a hole 18 which is sealingly closed by means of a closure plug or stopper 20.

Arranged in the casing front portion 14 of the cosmetic pencil 10 is a drive element 22 for a cosmetic stick 24, the drive element 22 being in the form of a tubular stick holding member 26. The stick holding member 26 is arranged in the casing front portion 14 axially movably while being prevented from rotating. For that purpose the casing front portion may be provided for example with longitudinal grooves 28 and the tubular stick holding member 26 may be provided with raised portions 30 (see FIG. 2) which project into the longitudinal grooves 28. The tubular stick holding member 26 has an outside surface 32 which is steplessly aligned with the peripheral surface 34 of the application portion 36 of the cosmetic stick 24, as can be seen from FIG. 2 in which identical details and features are denoted by the same references as in FIG. 1.

The outside surface 32 of the tubular stick holding member 26 and the peripheral surface 34 which is of the same—preferably cylindrical—peripheral contour, of the application portion 36 of the cosmetic stick 24 are virtually play-free adapted to the—preferably circular—internal contour 38 of the casing opening 40 in the casing front portion 14 of the cosmetic pencil 10. In other words, the cosmetic stick 24 is of an outside diameter which is slightly (sliding fit tolerance) smaller than the inside diameter of the casing opening 40, so that the arrangement eliminates a jamming effect or prevents stick material from being scraped off the cosmetic stick 24 at the casing opening 40.

Figure 2:
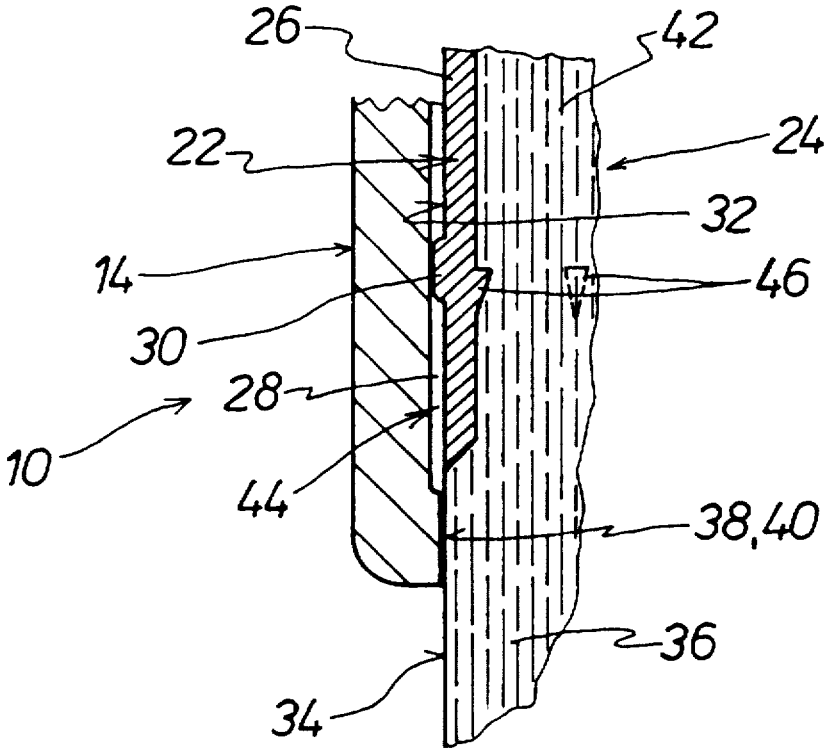
FIG. 2 is a view on an enlarged scale of the detail II in FIG. 1.

The cosmetic stick 24 is fixed with a rear fixing portion 42 in a front portion 44 of the tubular stick holding member 26. For the purposes of reliably fixing the fixing portion 42 of the cosmetic stick 24 in the above-mentioned front portion 44 of the tubular stick holding member 26, the front portion 44 is desirably provided with fixing elements 46. As shown in FIG. 2 the fixing elements 46 are for example barb-like raised portions, knobs or ribs; it will be appreciated that the fixing elements 46 can also be in the form of a peripherally extending stepped collar, shoulder or of any other desired configuration.

Figure 3:
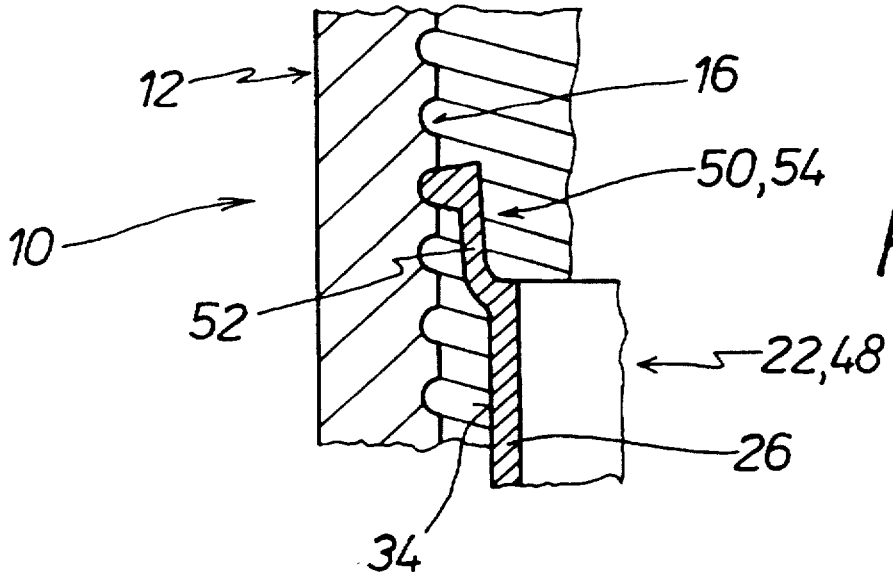
FIG. 3 is a view on an enlarged scale of the detail III in FIG. 1.

At its rear end portion 48 which at any time projects at the rear out of the casing front portion 14, the tubular stick holding member 26 has a male screwthread element 50 which can be screwed with the female screwthread portion 16 of the casing shank portion 12. The male screwthread element 50 can project away from or be formed by at least one resilient rib 52 in order to provide a resiliently yielding structure 54 for preventing over-rotation (see FIG. 3).

The tubular stick holding member 26 is of a length L1 which is slightly greater than the longitudinal extent L2 of the casing front portion 14, as is shown in FIG. 1. The stick holding member 26 and the casing front portion 14 are of such a configuration that, in manufacture of the cosmetic stick 14, it is admittedly possible for the stick holding member 26 to be caused to project with its front portion 44 in a defined fashion out of the casing front portion 14 or the casing opening 40, but thereafter, during use of the cosmetic pencil, such movement of the stick holding member 26 out of the casing opening 40 is no longer possible.

The diameter of the cosmetic stick 24 is identified by d in FIG. 1. It is constant and is preferably between 2 and 6 mm.

At its rearward end portion 48 the tubular stick holding member 26 is sealed off by a sealing element 56. That sealing element 56 is for example a ball which is clamped into the end portion 48 or a stopper, a wax plug or the like.

We claim:

1. A cosmetic pencil having a casing shank portion, a casing front portion connected to the casing shank portion, a drive element which is provided for moving a cosmetic stick in relation to a casing opening of the casing front portion and which is in the form of a tubular stick holding member which is arranged in the casing front portion and axially movably out of and back into the casing front portion, wherein the cosmetic stick which projects with an application portion out of the tubular stick holding member is fixed with a rear fixing portion in the tubular stick holding member, the peripheral surface of the application portion of the cosmetic stick is steplessly aligned with the outside surface of the tubular stick holding member, the tubular stick holding member is axially adjustably movably disposed in the casing front portion in such a way as to be prevented from rotating and at its rear end portion which projects at the rear out of the casing front portion it is provided with a male screwthread element, and the casing shank portion has a female screwthread portion in which the male screwthread element of the tubular stick holding member is screwably disposed, wherein the application portion of the cosmetic stick extends in a play-free condition through the casing opening of the casing front portion, the application portion of the cosmetic stick is of a constant diameter which is between 2 and 6 mm, the tubular stick holding member is of a length which is slightly greater than the longitudinal extent of the casing front portion, and the male screwthread element has a resiliently yielding means extending therefrom to the tubular stick holding member for preventing over-rotation.

2. A cosmetic pencil as set forth in claim 1, wherein the front portion of the tubular stick holding member is provided with fixing elements for the cosmetic stick.

3. A cosmetic pencil as set forth in claim 2, wherein the tubular stick holding member is sealed off at its rear end portion by a sealing element.

4. A cosmetic pencil as set forth in claim 1, wherein the tubular stick holding member is sealed off at its rear end portion by a sealing element.

* * * * *